United States Patent [19]

Erickson

[11] 4,147,358

[45] Apr. 3, 1979

[54] VIBRATING GAME APPARATUS WITH LOOSELY INTERFITTING SURFACE ELEMENTS

[75] Inventor: Erick E. Erickson, Chicago, Ill.

[73] Assignee: Marvin Glass & Associates, Chicago, Ill.

[21] Appl. No.: 872,426

[22] Filed: Jan. 26, 1978

[51] Int. Cl.[2] ..... A63F 3/00

[52] U.S. Cl. ..... 273/241; 273/85 E; 273/283; 273/243

[58] Field of Search ..... 273/241, 283, 281, 287, 273/86 E, 109, 11 D, 256, 278; 46/1 C, 137, 138, 248

[56] References Cited

U.S. PATENT DOCUMENTS

| | | | |
|---|---|---|---|
| 1,336,756 | 4/1920 | Pautzke | 46/138 |
| 2,199,499 | 5/1940 | Kreitler | 273/273 |
| 2,412,180 | 12/1946 | Slocum | 273/109 |
| 3,455,049 | 6/1969 | Dyer et al. | 46/47 |
| 3,769,743 | 10/1973 | Benkoe et al. | 46/1 C |
| 3,940,140 | 2/1976 | Meyer et al. | 273/109 |

*Primary Examiner*—Richard C. Pinkham
*Assistant Examiner*—Scott L. Brown
*Attorney, Agent, or Firm*—Mason, Kolehmainen, Rathburn & Wyss

[57] ABSTRACT

A game apparatus having the theme of prehistoric dinosaurs which eventually become extinct. The game apparatus includes a base supporting a floor which is adapted for vibrating motion and which represents a pool of hot lava. A manually operated vibrator is actuated repeatedly during play for imparting vibratory motion to the floor and a plurality of puzzle-like, earth elements mounted on the floor and interfitted together to form an elevated playing surface representing the earth's surface are adapted to move with respect to one another as the floor vibrates. As the earth elements move, a wide crack may develop between them. Game pieces in the form of dinosaurs are placed on the upper surface of the earth elements and are moved from element to element in response to the indications directed by a spinner which includes indicia thereon corresponding to indicia on the puzzle-like earth elements. In addition, the spinner provides instructions which call for activating the vibrator to represent an earthquake, during which the dinosaurs may topple over into the lava bed of the floor. The dinosaurs are thus removed from the game as they topple into the cracks and the last surviving dinosaur present on the land mass of the earth elements represents the winner of the game.

10 Claims, 8 Drawing Figures

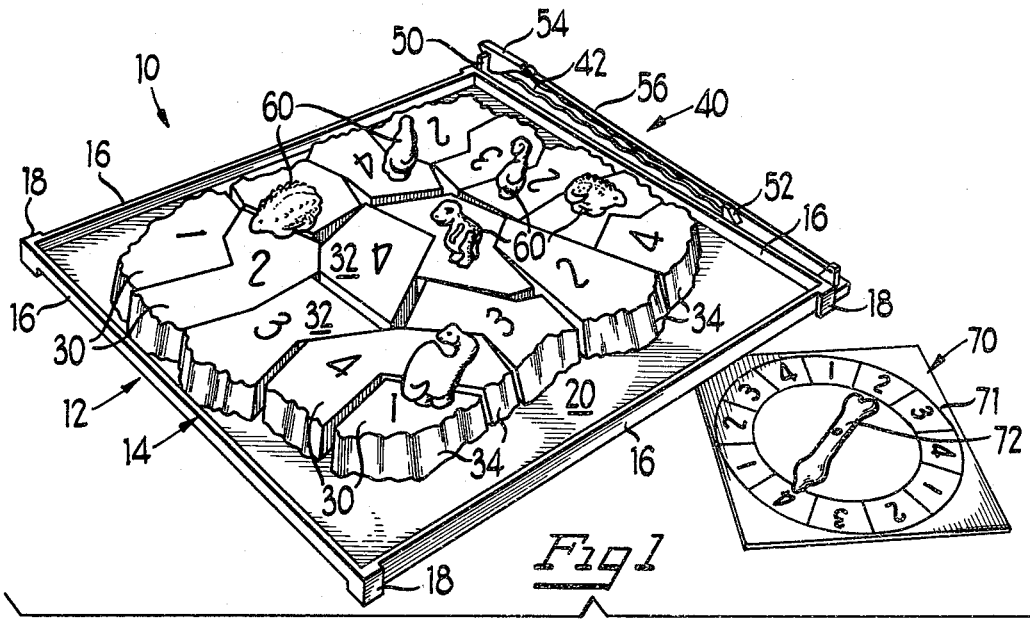
Fig 1
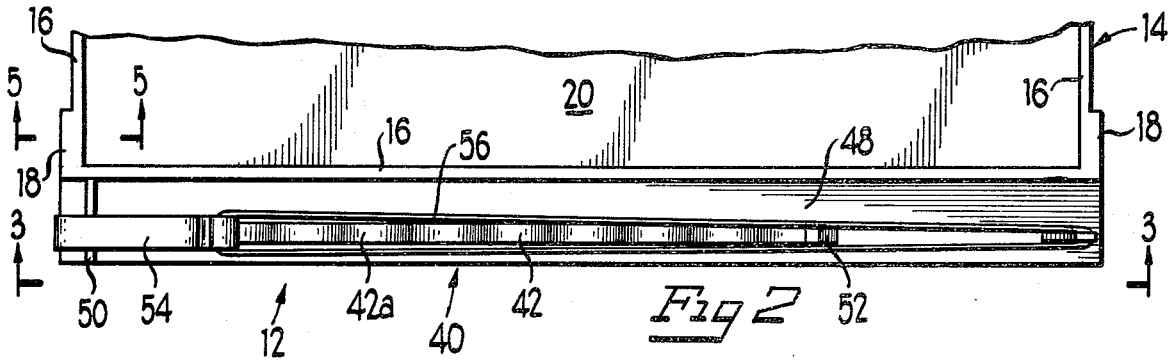
Fig 2
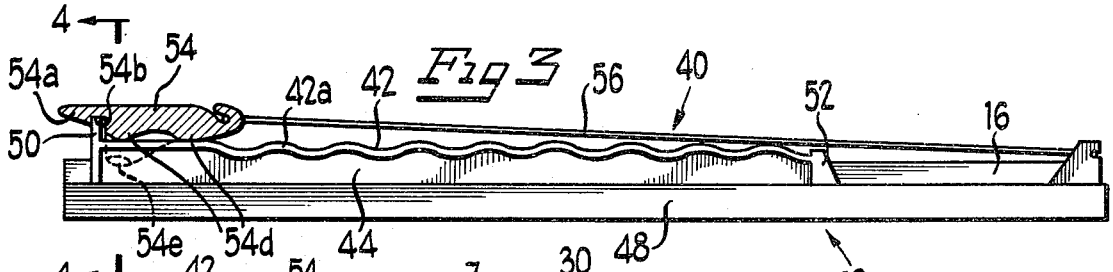
Fig 3
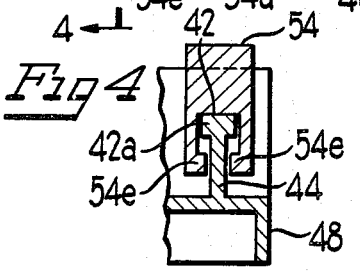
Fig 4
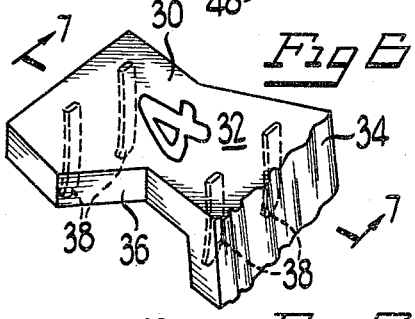
Fig 6
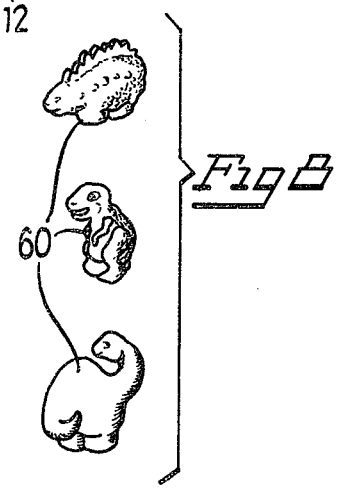
Fig 8
Fig 5
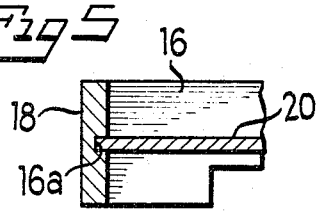
Fig 7
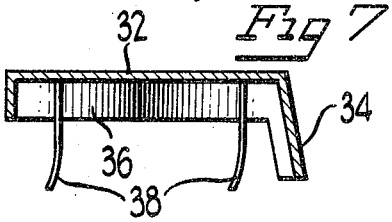

VIBRATING GAME APPARATUS WITH LOOSELY INTERFITTING SURFACE ELEMENTS

BACKGROUND OF THE INVENTION

1. Field of the Invention

The present invention relates to a new and improved game apparatus designed around the theme of prehistoric animals such as dinosaurs and an environment of play including earthquakes which eventually destroy the animals. The object of the game is to have the last dinosaur surviving on the playing surface.

2. Description of the Prior Art

A wide variety of games have been developed wherein prehistoric animals such as dinosaurs have played a roll. Some of these games have been developed around a theme wherein dinosaurs come to life at the present time and disrupt or take over human society. As far as is known, no games have been developed around a theme wherein dinosaurs and/or other prehistoric animals are gradually eliminated or destroyed and become extinct because of natural phenomenon such as an earthquake and no games are known wherein a play surface resembling the prehistoric world is made up of a plurality of separate puzzle-like elements which are activated to move as in an earthquake creating schisms and crevices into which game pieces representing prehistoric dinosaurs may fall and be destroyed by a hot lava bed.

SUMMARY OF THE INVENTION

It is therefor an object of the present invention to provide a new and improved game apparatus designed around a theme wherein prehistoric animals such as dinosaurs occupy an earth area which is subjected to repeated earthquakes that eventually eliminate the dinosaurs with the last remaining dinosaur representing the winner of the game.

Another object of the present invention is to provide a new and improved game apparatus of the character described wherein an irregular or uneven playing surface is provided for a number of game pieces representing prehistoric dinosaurs and the like and the playing surface is formed of a plurality of separately movable individual puzzle-like earth elements which are mounted on a vibratory floor for random movement with respect to one another.

It is another object of the present invention to provide a new and improved game apparatus of the character described wherein a vibratory floor represents a bed of lava into which animals may fall and are thus symbolically destroyed.

Another object is to provide a new game wherein an irregular play surface resembling the earth is formed by a plurality of adjacent puzzle-like earth elements.

Still another object of the present invention is to provide a new and improved game apparatus of the character described wherein novel means is provided for imparting vibratory motion to a supporting floor of puzzle-like earth elements assembled together for supporting a plurality of game pieces fashioned like prehistoric animals.

Still another object of the present invention is to provide a new and improved game apparatus of the character described which is interesting and exciting to play and which is helpful in teaching young people about prehistoric animals and the reasons for the eventual extinction thereof.

The foregoing objects of the present invention are accomplished in a new and improved game apparatus developed around the theme as described hereinbefore. The apparatus includes a base having a peripheral frame supporting a floor panel adapted for vibratory motion and a manual vibrator is provided for imparting vibratory motion to the floor. The floor supports a plurality of puzzle-like earth elements having upper surfaces representing the earth and initially interfitted together to form a contiguous land mass as an elevated playing surface of irregular shape of individual sections which represent the earth's surface. Each of the earth elements is movable independently of the others in response to vibrations of the supporting floor and as the floor is vibrated, cracks, chisms and crevices develop between adjacent edges of the puzzle-like earth segments. One or more game pieces in the form of prehistoric dinosaurs are provided for each player and the game pieces are placed upon the earth elements and are moved around the playing surface between different elements in a random fashion and as determined and directed by a chance device such as a spinner. From time to time, the players are directed to operate the vibratory apparatus causing the puzzle-like earth elements to move around and develop crevices or cracks into which the animals of opposing players may fall. When a dinosaur falls onto the floor which represents a hot lava bed, the animal is eliminated from the game and it is an object of the game to have the last remaining dinosaur present on the playing surface.

BRIEF DESCRIPTION OF THE DRAWINGS

For a better understanding of the present invention reference should be had to the following detailed description taken in conjunction with the drawings, in which:

FIG. 1 is a perspective view of a new and improved game apparatus of the character described and shown in a position ready for play;

FIG. 2 is a fragmentary, top plan view of an edge portion of the game apparatus including a vibrator for use during play of the game;

FIG. 3 is a side elevational view looking in the direction of arrows 3—3 of FIG. 2;

FIG. 4 is a fragmentary, cross-sectional view taken substantially along lines 4—4 of FIG. 3;

FIG. 5 is a fragmentary sectional view taken substantially along lines 5—5 of FIG. 2;

FIG. 6 is a perspective view of one of the puzzle-like earth elements used in the game for making up a playing surface for the animals constructed in accordance with the features of the present invention;

FIG. 7 is a vertical sectional view taken substantially along lines 7—7 of FIG. 6; and FIG. 8 is a perspective view of a set of game pieces for each player in accordance with the features of the present invention.

DESCRIPTION OF THE PREFERRED EMBODIMENT

Referring now more particularly to the drawings, in FIG. 1 is illustrated a new and improved game apparatus constructed in accordance with the features of the present invention and referred to generally by the reference numeral 10. The game apparatus is developed around a theme wherein prehistoric animals such as dinosaurs are eventually destroyed by earthquakes. The dinosaurs are movable over a playing surface designed to resemble the earth's surface which is made up of a plurality of puzzle-like earth elements supported for independent movement in response to a vibratory supporting floor. At periodic random intervals, the floor is vibrated by the action of a manually operated vibrator and this vibration causes the earth elements to move in random fashion with respect to one another forming cracks and crevices between the edges. Game pieces representing animals are placed on the earth elements and may fall into the space therebetween onto the floor which represents a hot lava bed. When an animal falls into a crevice and touches the floor it is removed from the game and the owner of the last remaining dinosaur in play wins the game.

In accordance with the invention, the game apparatus includes a base structure 12 formed with a square or rectangular outer frame 14 having a plurality of sidewalls 16 at right angles to one another and reinforced by thickened corner leg segments 18 as illustrated in FIGS. 1, 2 and 5. The sidewalls are adapted to support a relatively large floor surface 20 formed of cardboard or other flexible sheet material which is readily vibrated like a diaphragm when vibratory motion is imparted to the supporting frame 14. The outer peripheral edges of the floor 20 are seated within elongated support grooves 16*a* formed on the inside surface of the framework sidewalls 16 and as shown in FIG. 5, the floor is adapted to be supported at a level above the lower ends of the thickened corner section legs 18 which act as support legs or feet for the base 12. The surface of the floor is colored red and represents a hot lava bed which destroys any animal falling into contact therewith.

In accordance with the present invention, the vibratory floor 20 is adapted to support a plurality of puzzle-like, earth elements 30 of irregular shape, each including an upper surface 32 forming a portion of a plateau or land mass when the puzzle-like elements are assembled together as shown in FIG. 1 much like a jigsaw puzzle. Outer ones of the earth elements are provided with downwardly sloping outer edge portions 34 representing cliffs or the like of a relatively steep slope while along the inside adjoining edges, each puzzle element is provided with a skirt or sidewall 36 of lesser depth and adapted to abut the sidewall of an adjacent earth element. As illustrated in FIG. 1, when the earth's elements are assembled together as set forth by outlines of the elements on the floor 20 a contiguous plateau is formed above the floor and the upper surfaces 32 vary in height or elevation with some of the surfaces sloped or tilted with respect to others so that portions of the inner sidewalls 36 are clearly visible and resemble the surface of the earth as thought to exist in the age of prehistoric animals.

Preferably, the earth elements 30 are formed of integrally molded plastic material and each includes a plurality of depending, elongated filament-like flexible support legs 38 having curved lower ends which are deflected to slope in a selected direction so that the earth element will respond to vibration of the supporting floor 20 to move in a programmed manner in the direction of the slope. Depending upon the amplitude and phase of vibration, the individual earth elements 30 may also move in other random directions relative to one another and accordingly, wide and narrow gaps, crevices or cracks may develop between various sidewalls 36 of adjacent earth elements after repeated vibration periods of the floor surface 20.

In accordance with the present invention, vibratory motion is imparted to the floor 20 by means of a vibrator 40 mounted along one side of the base structure 12. The vibrator includes an elongated guide rail 42 having an upstanding vertical web 44 extending upwardly from a channellike base structure 48 with an inside edge flange formed by the adjacent sidewall 16 of the base 12. As illustrated in FIG. 4, the web of the guide rail and the base structure 14 are integrally formed and vibration of the rail imparts vibratory motion to the entire frame 14 of the base thereby causing the diaphragm-like support floor 20 to vibrate. The elongated rail 42 is provided with a pair of integral stops 50 and 52 at opposite ends for limiting the longitudinal sliding movement of a vibration producing slide 54 which is guided for longitudinal movement down the guide rail between the end stops. The slide is formed with a thin, finger-like outer end portion 54*a* and a notch 54*b* on the underside for retaining engagement with the upper edge of the stop 50 to hold the slide in position ready for use, as shown in FIG. 3. Adjacent the inner end, the upper edge of the slide is provided with a groove for receiving the end of a rubberband 56 which biases the slide towards the inner end stop 52 when the slide is released by upward lift on the finger 54*a*.

In accordance with the invention, the slide includes undulations 54*d* formed on the under surface thereof and these ridges are adapted to engage and strike the undulations of a head portion 42*a* along the upper edge of the guide rail web 44. As viewed in FIG. 4, the head of the guide rail is wider than the thickness of the web 44 and extends outwardly on either side thereof. The longitudinally spaced undulations including ridges and valleys are engaged by the ridges and valleys on the slide 54 as the slide moves rapidly toward the inner stop 52 when released under the bias of the rubberband. This movement imparts vibratory motion to the rail 42 which in turn is transmitted through the base 48 and adjacent sidewall 16 to vibrate the floor 20. Each time the slide 54 is released to run on the rail from the outer end stop 50 to the inner stop 52, vibrations are produced and these cause the respective earth elements 30 to move around over the floor developing cracks, crevices and schisms between their adjacent inside edges 36. When this occurs, surface portions of the floor 20 representing a lava bed are exposed.

In order to prevent the slide from becoming disengaged from the guide rail 42 as it moves down the rail when released, the slide includes a pair of depending fingers 54*e* which have inturned lower ends spaced beneath the underside of the undulating rail head portion 42*a*. After a vibrating stroke has been completed by the release of the slide 54, the slide is manually returned to the position shown in FIG. 3, and the rubberband 56 is again placed under tension ready for the next release of the slide when an "earthquake" is called for.

In accordance with the invention, the game apparatus 10 includes a plurality of sets of game pieces 60 as shown in FIGS. 1 and 8 and each player is provided with a set of dinasours in the form of a Stegosaurus, Brontosaurus and a Allosaurus of a particular color chosen by and representing the individual player. The game pieces are adapted to rest on the upper surfaces 32 of the earth elements 30 and a chance device such as a spinner 70 with a pointer in the form of a dinosaur bone 72 is provided for randomly determining the movements of the game pieces during play of the game.

The spinner 70 includes a board with an annular ring 71 divided into radial segments with number indicia on each segment and these indicia correspond to numerals on the upper surfaces 32 of the puzzle-like earth elements 30. In addition, several of the radial segments are colored "red" corresponding to the color of the surface of the support floor 20 and when the pointer lands on a "red" segment, a player is obliged to release the slide 54 to provide a vibration which simulates an "earthquake".

In playing the game, the earth elements 30 are initially assembled together closely like a jigsaw puzzle within a fiery outline provided on the support floor 20. The fiery outline includes segments which correspond to the shape of each puzzle-like earth element 30. After a few games have been played, a player can easily form the pieces together to form the continuous plateau or land mass ready for play. The elongated flexible legs 38 of each earth element are programmed so that the individual earth elements tend to move in a particular direction in response to the vibrations created by release of the slide 54 when an earthquake occurs.

In rotation, each player places one of his dinosaurs 60 on a selected earth element 30 not occupied by another dinosaur until all the dinosaurs of each player are in place on the plateau represented by the assembled earth elements. The player chosen to go first, then operates the spinner 70 and if the pointer 72 points to a "red" segment, the player then triggers an earthquake by releasing the slide 54 to zip down the rail and vibrate the floor 20. He then may move any one of his dinosaurs to an earth element 30 which is labeled with the same number as indicated by the pointer 72.

The dinosaur of one player may attack the dinosaur of another player by landing on the same earth element when indicated by the spinner. When this occurs, the attacking dinosaur then occupies the element and he scares the opponent's dinosaur toward any crack portion which is formed adjacent the earth element on which the "battle" took place, with the object being to place an opponent's dinosaur over the largest crack available and hoping that the dinosaur will fall into the crack and toward the floor 20 when the next earthquake occurs. If a dinosaur falls from the surface 32 of an earth element 30 and touches the lava bed represented by the floor 20, the dinosaur must be removed and is out of play. However, if a dinosaur merely falls over and does not touch the lava surface of the floor, the dinosaur can be saved on the player's next turn. If a dinosaur is dropped from the plateau of assembled earth elements for any reason during a player's move, it must be removed from play. However, if a player is attempting to balance an opponent's dinosaur in a precarious way over a crack and the dinosaur then falls before the next earthquake, the player owning the dinosaur can place the dinosaur on any unoccupied earth element 30.

The game continues with the players operating the spinner 70 in turn until there is only one dinosaur left on the plateau of earth elements 30. This player is the winner of the game.

Each time the pointer 72 points to a "red" colored segment on the spinning board, an earthquake must be triggered by the player before moving any of his dinosaurs. Each time an earthquake is developed, the earth elements 30 tend to move in their preprogrammed directions to developing cracks or crevices into which the dinosaurs may topple. Any time a dinosaur touches the fiery lava bed represented by the support surface 20, the dinosaur is out of the game as described and the player having the last surviving dinosaur, is the winner.

From the foregoing it will be seen that the game is interesting and exciting and provides an appreciation of how prehistoric dinosaurs and other animals may have become extinct due to natural disasters such as earthquakes and the like during the early years of life on this earth.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. Game apparatus, comprising:

a base including a peripheral frame supporting a floor adapted for vibratory motion;

means for imparting vibratory motion to said floor;

a plurality of puzzle-like elements adapted to be mounted on said floor and interfitted together to form an elevated playing surface, each of said elements being movable independently in response to vibration of said floor whereby a break may be developed in said playing surface between edges of adjacent elements; and one or more playing pieces adapted to be placed on said playing surface for movement thereon until a break formed by vibration of said floor causes a playing piece to move from said playing surface to touch said floor.

2. The game apparatus of claim 1 wherein said puzzle-like elements are shaped with irregular side edges adapted to be interfitted together to initially form a relatively large contiguous area resembling a portion of the earth's surface.

3. The apparatus of claim 1 wherein each of said puzzle-like elements includes an upper surface forming a fragment of said playing surface, and at least one of said upper surfaces spaced above said floor at a level different than that of an adjacent puzzle-like element.

4. The game apparatus of claim 3 wherein at least one of said upper surfaces of a puzzle-like element is sloped with respect to said floor.

5. The game apparatus of claim 1 wherein said puzzle-like elements have differentiating indicia thereon and including chance means for randomly selecting particular puzzle-like elements by means of said indicia for directing the movement of a playing piece onto a selected puzzle-like element.

6. The game apparatus of claim 5 wherein said chance means includes indicia thereon adapted to be randomly determined for directing the operation of said means for imparting vibratory motion to said floor.

7. The game apparatus of claim 1 wherein said means for imparting vibratory motion to said floor comprises an elongated guide rail along one side of said floor having longitudinal undulations along one edge thereof, and a vibration generator mounted for longitudinal movement along said rail including an edge with undulations thereon for contacting the undulations on said guide rail during movement along said rail.

8. The game apparatus of claim 7 wherein said guide rail includes stops at opposite ends thereof for limiting the longitudinal travel of said generator between said stops.

9. The game apparatus of claim 8 wherein said generator and one of said stops comprise manually releasable latch means for retaining said generator adjacent said stop until released and bias means urging said generator toward said other stop for generating vibration.

10. The game apparatus of claim 7 wherein said guide rail includes an upstanding web and a laterally outwardly extending flange forming said undulations, said vibration generator including a pair of fingers extending downwardly of said flange on opposite sides of said web and engageable with lower surfaces of said flange for retaining said generator on said guide rail during longitudinal movement thereon.

* * * * *